US009440822B2

(12) United States Patent
Pulido

(10) Patent No.: US 9,440,822 B2
(45) Date of Patent: Sep. 13, 2016

(54) WHEEL TRANSPORTING ASSEMBLY

(71) Applicant: Jorge Pulido, Keyes, CA (US)

(72) Inventor: Jorge Pulido, Keyes, CA (US)

( * ) Notice: Subject to any disclaimer, the term of this patent is extended or adjusted under 35 U.S.C. 154(b) by 0 days.

(21) Appl. No.: 14/551,637

(22) Filed: Nov. 24, 2014

(65) Prior Publication Data

US 2016/0145079 A1 May 26, 2016

(51) Int. Cl.
*B66C 1/24* (2006.01)

(52) U.S. Cl.
CPC ..... *B66C 1/24* (2013.01)

(58) Field of Classification Search
CPC ..... B66C 1/24
USPC ..... 294/67.21, 67.22, 63.1, 82.23, 103.2; 414/639, 645
See application file for complete search history.

(56) References Cited

U.S. PATENT DOCUMENTS 1,195,518 A * 8/1916 Simpson ..... B66C 1/24 294/67.2
2,325,235 A * 7/1943 Esbeck ..... B61K 5/00 294/67.22
2,422,467 A 6/1947 Carroll
2,672,185 A 3/1954 Bergeron
2,816,792 A * 12/1957 Dixon ..... B66C 1/24 294/103.2
3,144,088 A * 8/1964 Kaplan ..... G01G 19/16 177/147
3,165,344 A * 1/1965 Holder ..... B66C 1/26 294/63.1
3,339,764 A * 9/1967 Stanfield ..... B65F 1/12 294/67.22
3,517,959 A * 6/1970 Ferguson ..... B66C 1/62 294/67.22
3,776,511 A 12/1973 Bott
4,022,341 A * 5/1977 Lindquist ..... B60B 29/001 294/93
4,475,758 A * 10/1984 Paulsson ..... B66C 1/26 294/63.1
4,646,806 A 3/1987 Richardson
4,784,419 A * 11/1988 Jensen ..... B66C 1/24 294/103.2
4,919,465 A * 4/1990 Gembarosky ..... B66C 1/24 267/140
5,009,257 A 4/1991 Reeves
5,806,578 A 9/1998 Gonzaga
7,156,141 B1 1/2007 Kliskey
7,261,136 B1 8/2007 Kliskey
8,376,432 B1 * 2/2013 Hagler ..... B66C 1/62 294/67.22
2006/0175850 A1 * 8/2006 Mantsinen ..... B66C 1/24 294/67.2

* cited by examiner

*Primary Examiner* — Paul T Chin

(57) ABSTRACT

A wheel transporting assembly includes a cradle. The cradle comprises a central section, a top section and a bottom section each coupled to and extending away from the central section. The cradle may engage a wheel while the wheel is mounted on a vehicle. The cradle avoids contact with a body of the vehicle while the wheel is removed from the vehicle. A mount is coupled to the cradle. The mount may be engaged to a lift to facilitate the wheel to be transported away from the vehicle. A loop is coupled to the cradle. The loop may have a cord coupled between the loop and the wheel to facilitate the wheel to be retained on the cradle.

11 Claims, 5 Drawing Sheets

WHEEL TRANSPORTING ASSEMBLY

BACKGROUND OF THE DISCLOSURE

Field of the Disclosure

The disclosure relates to transporting devices and more particularly pertains to a new transporting device for transporting a wheel coupled to a vehicle without contacting the vehicle.

SUMMARY OF THE DISCLOSURE

An embodiment of the disclosure meets the needs presented above by generally comprising a cradle. The cradle comprises a central section, a top section and a bottom section each coupled to and extending away from the central section. The cradle may engage a wheel while the wheel is mounted on a vehicle. The cradle avoids contact with a body of the vehicle while the wheel is removed from the vehicle. A mount is coupled to the cradle. The mount may be engaged to a lift to facilitate the wheel to be transported away from the vehicle. A loop is coupled to the cradle. The loop may have a cord coupled between the loop and the wheel to facilitate the wheel to be retained on the cradle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
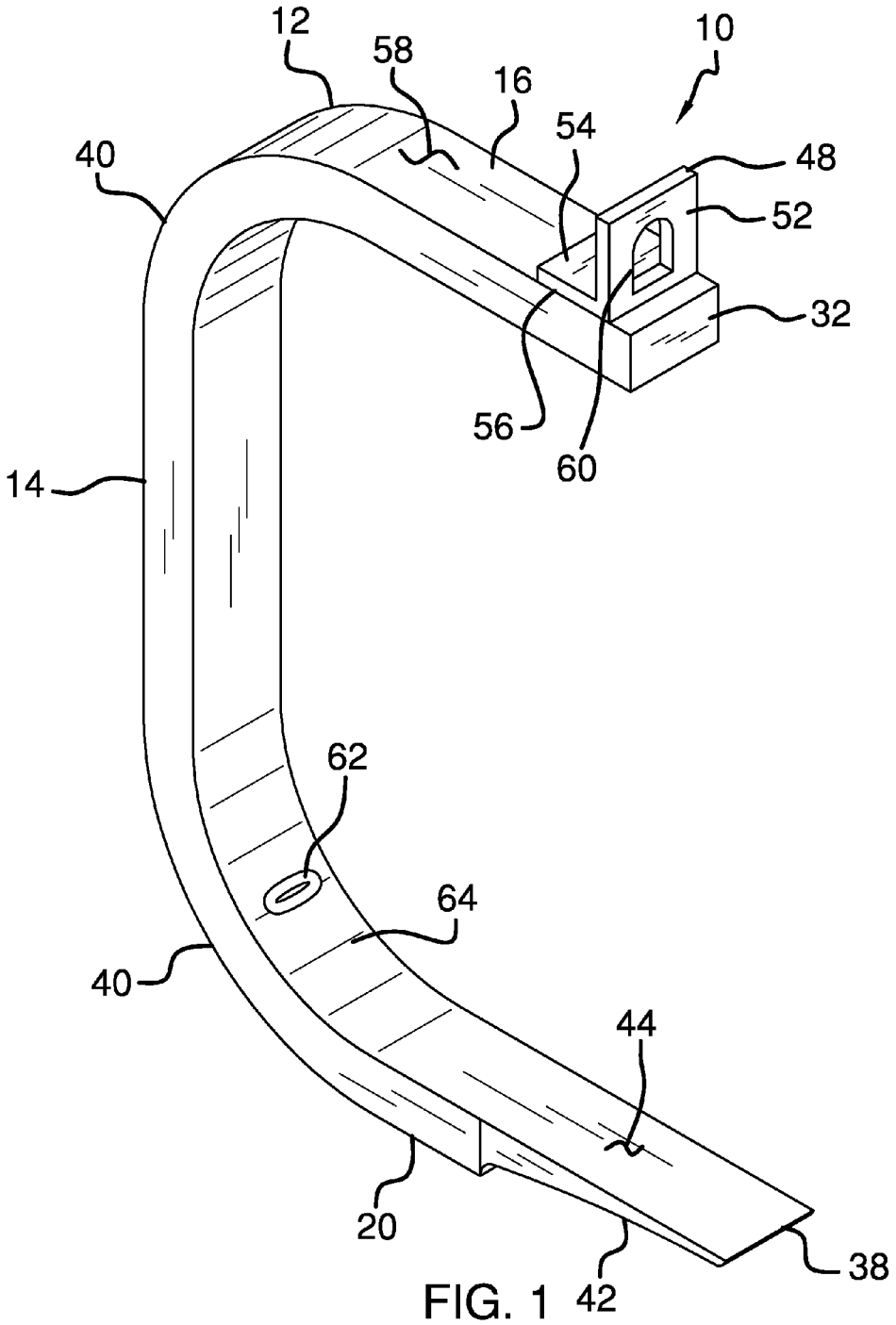
FIG. 1 is a perspective view of a wheel transporting assembly according to an embodiment of the disclosure.
Figure 2:
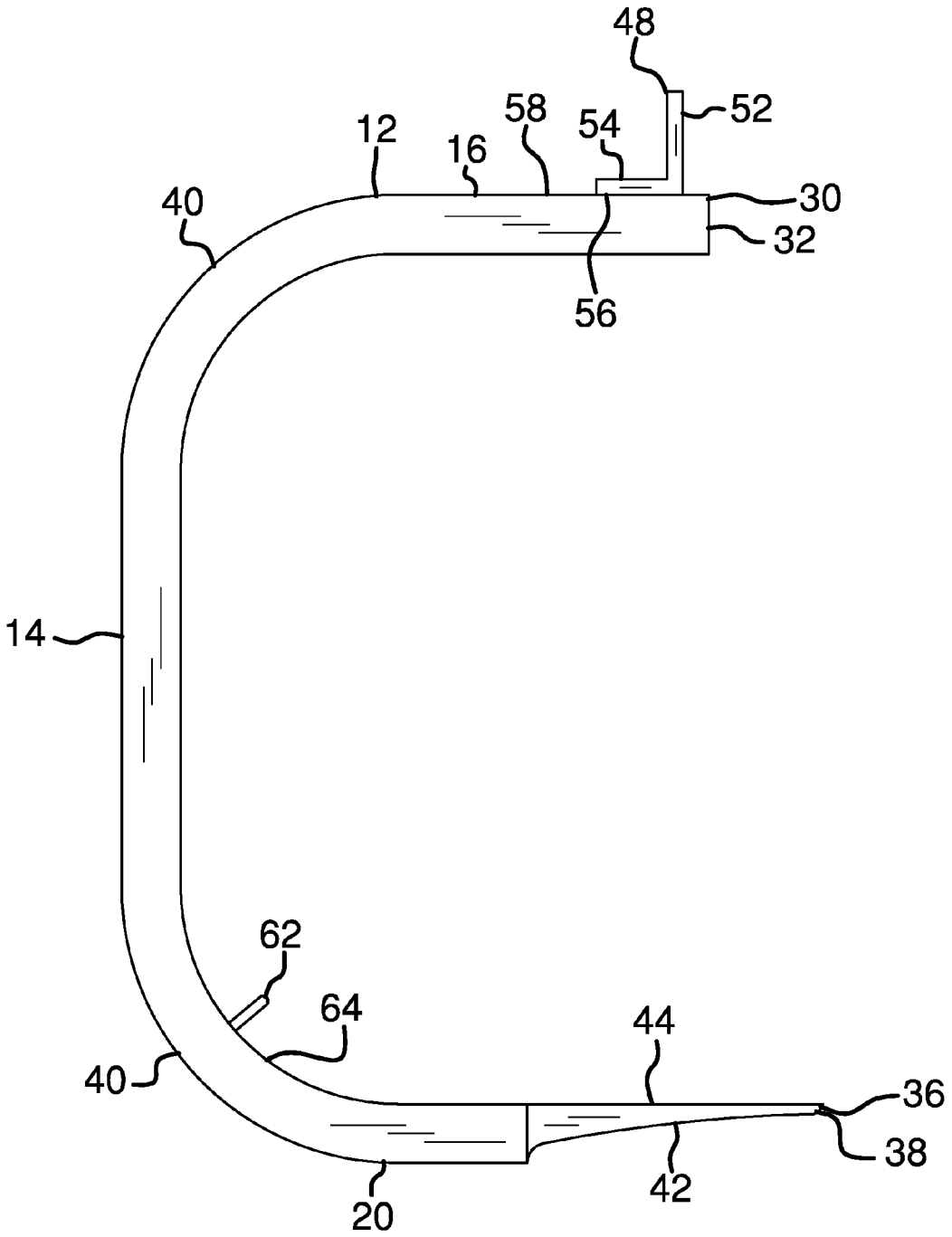
FIG. 2 is a right side view of an embodiment of the disclosure.
Figure 3:
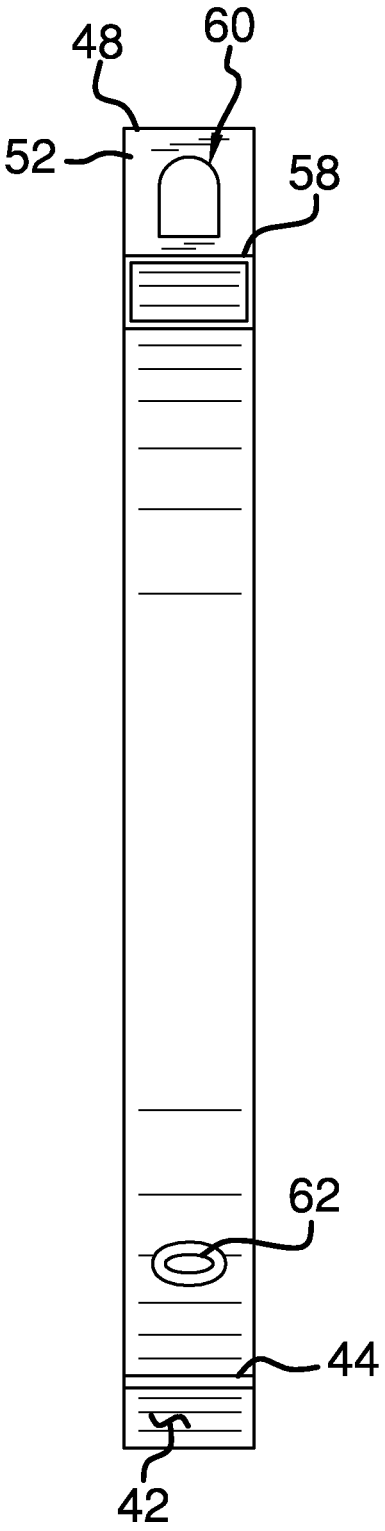
FIG. 3 is a front view of an embodiment of the disclosure.
Figure 4:
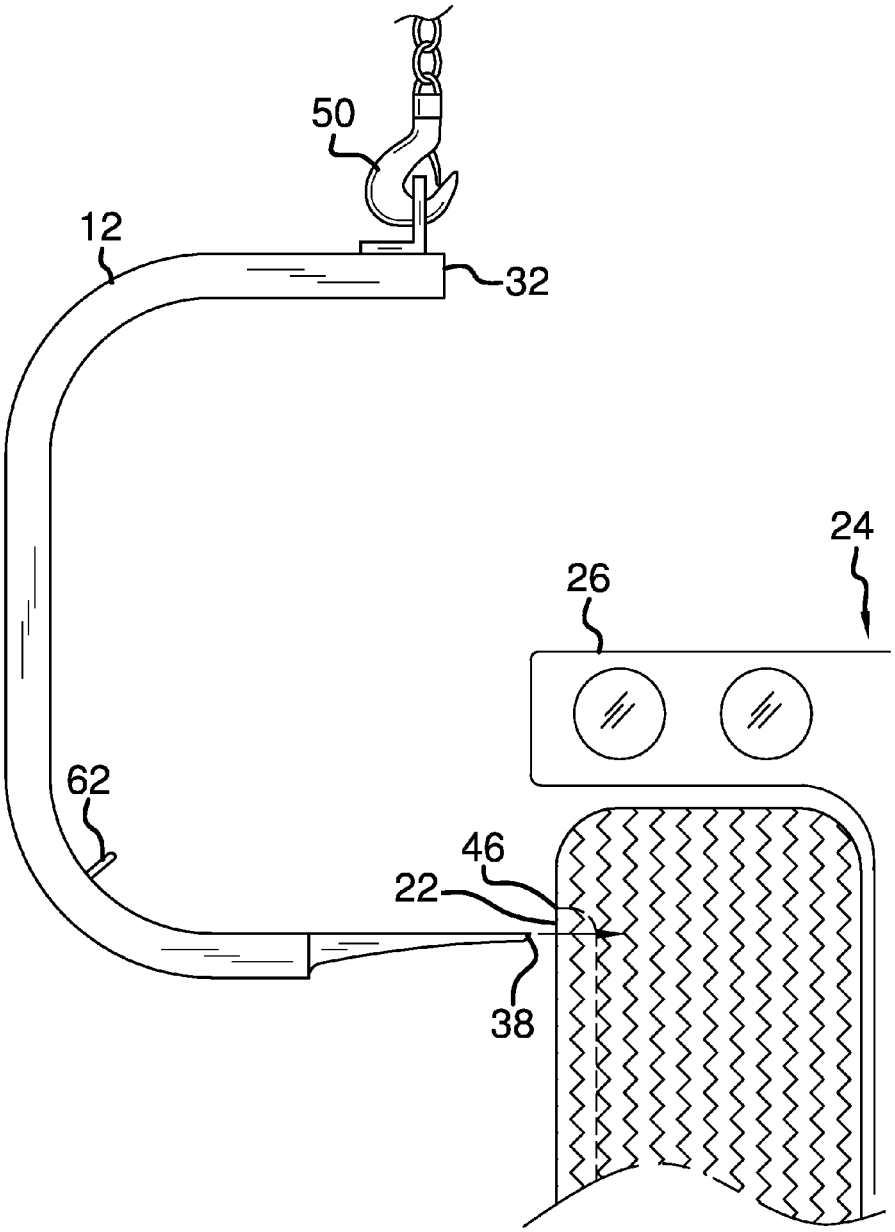
FIG. 4 is an in-use view of an embodiment of the disclosure showing a wheel coupled to a vehicle.
Figure 5:
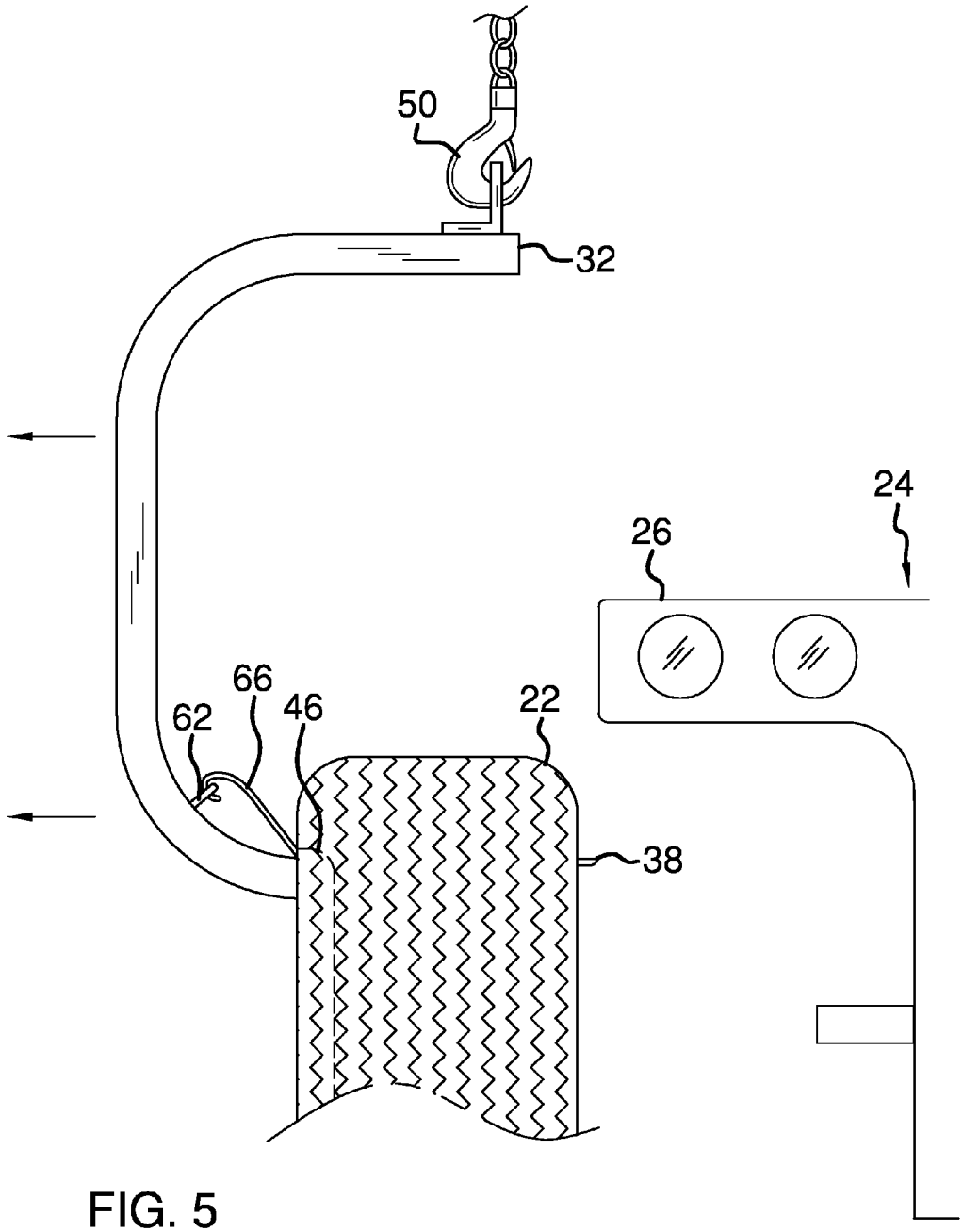
FIG. 5 is an in-use of an embodiment of the disclosure showing the wheel removed from the vehicle

With reference now to the drawings, and in particular to FIGS. 1 through 5 thereof, a new transporting device embodying the principles and concepts of an embodiment of the disclosure and generally designated by the reference numeral 10 will be described.

As best illustrated in FIGS. 1 through 5, the wheel transporting assembly 10 generally comprises a cradle 12. The cradle 12 comprises a central section 14, a top section 16 and a bottom section 20 each coupled to and extending away from the central section 14. The cradle 12 may engage a wheel 22 while the wheel 22 is mounted on a vehicle 24. The vehicle 24 may be tractor. The cradle 12 avoids contact with a fender 26 of the vehicle 24 while the wheel 22 is removed from the vehicle 24.

The top section 16 has a terminal end 30 to define a first end 32 of the cradle 12. The bottom section 20 has a terminal end 36 to define a second end 38 of the cradle 12. The cradle 12 has a pair of arcuate sections 40, giving the cradle 12 a C-shape. The bottom section 20 has a lower surface 42 and an upper surface 44. The lower surface 42 tapers toward the upper surface 44 adjacent to the second end 38 such that the bottom section 20 has a wedge shape. The bottom section 20 may engage a rim 46 of the wheel 22.

A mount 48 is coupled to the cradle 12. The mount 48 may be engaged by a lift 50 to facilitate the wheel 22 to be transported away from the vehicle 24. The mount 48 has a vertical portion 52 coupled to and extending upwardly from a horizontal portion 54. The horizontal portion 54 has a basal surface 56. The top section 28 has an uppermost surface 58. The basal surface 56 is coupled to the uppermost surface 58 such that the vertical portion 52 is positioned proximate the first end 32 of the cradle 12. The horizontal portion 54 has an opening 60 extending therethrough to be engaged by the lift 50.

A loop 62 is coupled to the cradle 12. The pair of arcuate sections 40 includes a lower arcuate section 64. The loop 62 is positioned adjacent to a junction of the lower arcuate section 64 and the bottom section 20. The loop 62 may have a cord 66 coupled between the loop 62 and the wheel 22, retaining the wheel 22 on the cradle 12.

In use, the vehicle 24 is raised to allow the wheel 22 to be removed from the vehicle 24. The bottom section 20 is positioned to engage the rim 46 of the wheel 22. The cradle 12 is lifted with the lift 50 to transfer the weight of the wheel 22 onto the cradle 12. The wheel 22 is urged off the vehicle 24. The cradle 12 is used to transport the wheel 22 when the wheel 22 is removed from the vehicle 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheel transporting assembly configured to transport a wheel, said assembly comprising:

a cradle comprising a central section, a top section and a bottom section each coupled to and extending away from said central section, said cradle being configured to engage a wheel while the wheel is mounted on a vehicle to facilitate said cradle to avoid contact with a body of the vehicle while the wheel is removed from the vehicle, said top section having a terminal end to define a first end of said cradle, said bottom section having a terminal end to define a second end of said cradle, said cradle having a pair of arcuate sections such that said cradle has a C-shape, said bottom section having a lower surface and an upper surface, said upper surface being planar, said lower surface tapering toward said upper surface adjacent to said second end such that said bottom section has a wedge shape terminating in a flat edge oriented perpendicular to a longitudinal axis of said bottom section wherein said bottom section is configured to engage a rim of the wheel supporting the wheel on said upper surface, said bottom section having a length extending from said central section greater than a length of said top section extending from said central section;

a mount coupled to said cradle, said mount being configured to be engaged to a lift to facilitate the wheel to be transported away from the vehicle; and a loop coupled to said cradle, said loop being configured to have a cord coupled between said loop and the wheel to facilitate the wheel to be retained on said cradle.

2. The assembly according to claim 1, wherein said mount having a vertical portion coupled to and extending upwardly from a horizontal portion, said horizontal portion having a basal surface.

3. The assembly according to claim 2, wherein said top section having an uppermost surface, said basal surface being coupled to said uppermost surface such that said vertical portion is positioned proximate said first end of said cradle.

4. The assembly according to claim 3, wherein said horizontal portion having an opening extending therethrough wherein said opening is configured to be engaged by the lift.

5. The assembly according to claim 1, wherein said pair of arcuate sections including a lower arcuate section, said loop being positioned adjacent to a junction of said lower arcuate section and said bottom section.

6. A wheel transporting assembly configured to transport a wheel, said assembly comprising:

a cradle comprising a central section, a top section and a bottom section each coupled to and extending away from said central section, said cradle being configured to engage a wheel while the wheel is mounted on a vehicle to facilitate said cradle to avoid contact with a body of the vehicle while the wheel is removed from the vehicle, said top section having a terminal end to define a first end of said cradle, said bottom section having a terminal end to define a second end of said cradle, said cradle having a pair of arcuate sections that said cradle has a C-shape, said bottom section having a lower surface and an upper surface, said upper surface being planar, said lower surface tapering toward said upper surface adjacent to said second end such that said bottom section has a wedge shape terminating in a flat edge oriented perpendicular to a longitudinal axis of said bottom section wherein said bottom section is configured to engage a rim of the wheel supporting the wheel on said upper surface, said bottom section having a length extending from said central section greater than a length of said top section extending from said central section;

a mount coupled to said cradle, said mount being configured to be engaged to a lift to facilitate the wheel to be transported away from the vehicle, said mount having a vertical portion coupled to and extending upwardly from a horizontal portion, said horizontal portion having a basal surface, said top section having an uppermost surface, said basal surface being coupled to said uppermost surface such that said vertical portion is positioned proximate said first end of said cradle, said horizontal portion having an opening extending therethrough wherein said opening is configured to be engaged by the lift; and a loop coupled to said cradle, said pair of arcuate sections including a lower arcuate section, said loop being positioned adjacent to a junction of said lower arcuate section and said bottom section, said loop being configured to have a cord coupled between said loop and the wheel to facilitate the wheel to be retained on said cradle.

7. A wheel transporting assembly configured to transport a wheel, said assembly comprising:

a tractor having a fender coupled thereto;

a wheel coupled to said tractor such that said wheel is positioned beneath said fender;

a cradle comprising a central section, a top section and a bottom section each coupled to and extending away from said central section, said cradle being engageable to said wheel such that said top section extends in spaced relationship over said fender while said wheel is mounted on said tractor to facilitate said cradle to avoid contact with said fender while said wheel is removed from said tractor, said top section having a terminal end to define a first end of said cradle, said bottom section having a terminal end to define a second end of said cradle, said cradle having a pair of arcuate sections such that said cradle has a C-shape, said bottom section having a lower surface and an upper surface, said upper surface being planar, said lower surface tapering toward said upper surface adjacent to said second end such that said bottom section has a wedge shape terminating in a flat edge oriented perpendicular to a longitudinal axis of said bottom section wherein said bottom section is configured to engage a rim of the wheel supporting the wheel on said upper surface, said bottom section having a length extending from said central section greater than a length of said top section extending from said central section;

a mount coupled to said cradle, said mount being configured to be engaged to a lift to facilitate said wheel to be transported away from said tractor; and a loop coupled to said cradle, said loop being configured to have a cord coupled between said loop and said wheel to facilitate said wheel to be retained on said cradle.

8. The assembly according to claim 7, wherein said mount having a vertical portion coupled to and extending upwardly from a horizontal portion, said horizontal portion having a basal surface.

9. The assembly according to claim 8, wherein said top section having an uppermost surface, said basal surface being coupled to said uppermost surface such that said vertical portion is positioned proximate said first end of said cradle.

10. The assembly according to claim 9, wherein said horizontal portion having an opening extending therethrough wherein said opening is configured to be engaged by the lift.

11. The assembly according to claim 7, wherein said pair of arcuate sections including a lower arcuate section, said loop being positioned adjacent to a junction of said lower arcuate section and said bottom section.

* * * * *